United States Patent [19]

Harding

[11] Patent Number: 4,942,067

[45] Date of Patent: Jul. 17, 1990

[54] WOOD PRESERVATIVE AND METHOD FOR PRESERVING WOOD

[76] Inventor: Norman T. Harding, 713 Wood St., Pittsburgh, Pa. 15221

[21] Appl. No.: 328,688

[22] Filed: Mar. 27, 1989

[51] Int. Cl.[5] ..... B05D 1/18

[52] U.S. Cl. ..... 427/393; 427/397

[58] Field of Search ..... 106/15.05, 5, 11; 427/393, 397

[56] References Cited

U.S. PATENT DOCUMENTS

| | | | |
|---|---|---|---|
| 1,211,188 | 1/1917 | Leraas | 106/11 |
| 1,490,268 | 4/1924 | Groff | 106/11 |
| 3,501,339 | 3/1970 | Gurgiolo | 427/397 X |
| 3,992,335 | 11/1976 | Denissenko et al. | 106/5 |
| 4,654,080 | 3/1987 | Harding | 106/15.05 |

*Primary Examiner*—Shrive Beck

*Attorney, Agent, or Firm*—Buchanan Ingersoll

[57] ABSTRACT

A method for preserving wood uses a pressurized solution of concentrated thujone oil. The concentrated thujone oil is applied to the wood to be preserved at a pressure in the range of 120 to 200 p.s.i. Preferably, the wood to be preserved is heated to about 110° before application of the thujone oil. The thujone oil penetrates deep into the wood to provide a long-lasting wood preservative effect. In addition, the wood preservative imparts a cedar aroma to the preserved wood.

3 Claims, No Drawings

WOOD PRESERVATIVE AND METHOD FOR PRESERVING WOOD

BACKGROUND OF THE INVENTION

1. Field of the Invention

The present invention relates to a natural wood preservative and a method for preserving wood.

2. Description of the Prior Art

It is known that certain oils when topically applied on finished wood products provide a preservative quality for the wood. Such oils coat the exterior surface of the wood, but generally do not penetrate deep into the wood. When the coating wears off by wear, evaporation, or decomposition, the wood is left unprotected. Consequently, repeated applications of the oil on the wood are needed to maintain the preserved nature of the wood. There is a need for a method to preserve wood which avoids the need to repeatedly apply the preservative.

SUMMARY OF THE INVENTION

I provide a natural wood preservative comprising concentrated thujone oil, a naturally-occurring oil of the wormwood plant and a component of cedar leaf oil from the cedar tree. I extract the thujone oil from its naturally-occurring sources to form a concentrated solution suitable for use in the method of my invention.

Once a sufficient quantity of thujone oil is extracted, it is stored in a pressurized applicator. The wood to which the thujone oil is to be applied is heated to approximately 110° F. The concentrated thujone oil is applied onto the heated wood at a pressure in the range of 120 p.s.i. to 200 p.s.i. Under these temperature and pressure conditions, the thujone oil is forced deep into the wood. By penetrating into the wood, the concentrated thujone oil provides a long-lasting preservative which will not wear away over time.

DESCRIPTION OF THE PREFERRED EMBODIMENTS

Concentrated thujone oil is extracted directly from the wormwood plant or indirectly from the ceder leaf plant. The concentrated thujone oil is collected and is placed in a pressurized applicator. Pressures in the range of 120 p.s.i. to 200 p.s.i. are preferred.

The wood to be preserved is heated to approximately 110° F. The wood need not be finished. Rather, because the thujone oil penetrates deep into the wood, the wood can be preserved by this method even if it is in its unfinished state.

Once the temperature and pressure conditions are satisfied, the thujone oil can be applied to the wood. Because the thujone oil is applied under pressure, it penetrates deep into the wood. Penetrating thujone oil does not wear away, evaporate, or decompose like topically applied thujone oil or topically applied wood preservatives. Consequently, penetrating thujone oil provides long-lasting preservative properties. I have found that wood treated in accordance with this method has remained preserved for over 3 years.

I have found that application of the thujone oil to wood produces a pleasing aroma in the wood. The thujone oil imparts a cedar-like aroma to the wood which it preserves. By utilization of wood treated in accordance with my invention, one can construct consumer goods such as storage chests or other furniture out of ash, oak, black oak or other species of wood and impart a cedar aroma to the wood. These storage chests and other furniture constructed of relative inexpensive wood possess the pleasing aroma of cedar wood even though they do not contain the expensive cedar wood.

In the foregoing specification, I have set out certain preferred practices and embodiments of this invention. However, it will be understood that this invention may be otherwise embodied within the scope of the following claims.

I claim:

1. A method for preserving wood comprising the steps of (a) producing a concentrated solution of thujone oil;

(b) heating the wood to be preserved; and (c) applying the concentrated solution of thujone oil to the heated wood at a pressure approximately in the range of 120 p.s.i. to 2000 p.s.i.

2. The method of claim 1 wherein the wood is heated to approximately 110° F.

3. The method of claim 1 wherein the preserved wood is imparted with a cedar aroma.

* * * * *